United States Patent [19]

Saponara et al.

[11] 4,431,889

[45] Feb. 14, 1984

[54] COMBINATION MICROWAVE AND CONVECTION OVEN

[75] Inventors: Domenick Saponara, Macungie; William J. Day, Allentown, both of Pa.

[73] Assignee: Raytheon Company, Lexington, Mass.

[21] Appl. No.: 513,783

[22] Filed: Jul. 14, 1983

Related U.S. Application Data

[63] Continuation of Ser. No. 319,536, Nov. 9, 1981, abandoned.

[51] Int. Cl.[3] ..... H05B 6/64

[52] U.S. Cl. ..... 219/10.55 F; 219/10.55 R; 219/400; 126/21 A; 126/39 E; 126/39 B

[58] Field of Search ..... 219/10.55 F, 10.55 D, 219/10.55 R, 10.55 B, 400; 126/21 A, 21 R, 39, 39 C, 39 B, 39 BA, 39 G, 39 E, 273 R, 275 E; 431/335, 300, 354

[56] References Cited

U.S. PATENT DOCUMENTS

| | | | |
|---|---|---|---|
| 1,052,126 | 2/1913 | Bradley | 431/335 |
| 2,488,388 | 11/1949 | Evans | 126/39 G |
| 2,494,243 | 1/1950 | Houlis | 431/354 X |
| 2,910,566 | 10/1959 | Smith | 219/10.55 F |
| 2,962,090 | 11/1960 | Braithwaite | 431/335 |
| 3,783,219 | 1/1974 | Tateda | 219/10.55 F |
| 3,884,213 | 5/1975 | Smith | 219/400 X |
| 3,926,106 | 12/1975 | Deusing et al. | 126/21 A |
| 3,978,843 | 9/1976 | Durth | 219/400 X |
| 4,053,730 | 10/1977 | Baron et al. | 219/10.55 F |
| 4,211,909 | 7/1980 | Yoshida et al. | 219/10.55 R |

FOREIGN PATENT DOCUMENTS

| | | | |
|---|---|---|---|
| 2757710 | 6/1978 | Fed. Rep. of Germany | 219/10.55 F |
| 1538851 | 1/1979 | United Kingdom . | |

*Primary Examiner*—B. A. Reynolds
*Assistant Examiner*—Philip H. Leung
*Attorney, Agent, or Firm*—William R. Clark; Joseph D. Pannone; Herbert W. Arnold

[57] ABSTRACT

A combination microwave and convection oven in which a gas burner positioned outside the oven provides heated combustion products which are drawn from the burner area along with vapor from an outlet of the oven by a blower system and the combined output of the blower system is blown into the oven through an oven inlet region in the oven wall. Both the oven outlets and the oven inlet are formed of holes substantially less than one-half wavelength in diameter. A predetermined portion of the blower output system is blown through an exhaust vent thereby creating slight negative pressures in the oven and in the burner plenum to accurately control the air flow through the burner.

6 Claims, 3 Drawing Figures

COMBINATION MICROWAVE AND CONVECTION OVEN

CROSS-REFERENCE TO RELATED APPLICATIONS

This is a continuation of application Ser. No. 319,536 filed Nov. 9, 1981, which is a continuation of application Ser. No. 165,438, filed July 2, 1980, which is a continuation of application Ser. No. 963,604, filed Nov. 24, 1978 (all abandoned).

BACKGROUND OF THE INVENTION

Microwave ovens have had electric heaters positioned inside the oven to aid in the cooking and/or browning process and have had electrically heated air or air used to cool electrical components such as magnetrons, power supplies, or magnetrons directed through the oven to aid in controlling vapors produced by a food body.

However, attempts to use the products of combustion in cooking regions excited with microwave energy have been generally unsatisfactory. Open gas flames in the oven can, among other things, act as sources of ionization which can absorb large portions of the microwave energy.

SUMMARY OF THE INVENTION

In accordance with this invention there is disclosed an oven which can be heated by combustion products blown into the oven by blower system which draws heated vapor comprising the combustion products from a burner plenum and controls the air drawn through the burner. More specifically, the blower system blows the mixture of vapor drawn from the oven and the vapor comprising the burner products of combustion and secondary air back into the oven with a small portion of the mixture being blown out an exhaust vent to create a slight negative pressure in the burner plenum so a predetermined amount of air will enter the burner.

This invention further discloses that the temperature of the vapors blown into the oven can be controlled by a thermostatic switch which controls an on/off cycle of the burner.

This invention further provides that the output of the oven circulation blower enters the oven through the back wall adjacent the upper oven surface. Such a direction of heated vapor into the oven has been found to substantially improve heating pattern uniformity and to assist in browning the upper surfaces of food products such as pastries or cakes or meat products by microwave energy while using less circulation blower power than other conconvection ovens.

In accordance with this invention the burner heats a region of a burner plenum during the time when the burner is energized and the oven circulating blower system draws air through a gas burner, and draws vapor from the oven to heat the vapor and to circulate the heated vapor through the oven. However, when the burner is off, for example, during the period when a thermostat senses that the oven temperature has reached a value corresponding to that which has been manually selected for a cooking temperature, the circulating fan continues to draw air through the burner plenum where it is heated by the heated region of the burner plenum.

In accordance with this invention it has been discovered that a very rapid rate of cooking of a food body can occur even when the oven is first energized and the walls are still cool. The uniformity of the cooking pattern is believed to occur due to the velocity of air being directed into the top of the oven from two counter rotating fans spaced behind the oven wall so that the oven inlet duct has a uniform pattern of air issuing from all parts thereof.

Further in accordance with this invention each motor driving one of the oven recirculating blowers is separated from the recirculating blower by a second blower on the same shaft as the recirculating blower. The second blower prevents thermal energy leaking along the rotor shaft by conduction from heating the motor. Rather the second blower draws air over the motor to cool the motor and supplies the air to an exhaust vent where it is mixed with the portion of the vapor output from the oven circulating blower to cool said portion prior to venting.

This invention is particularly useful in a microwave oven wherein the burner is outside the microwave enclosure and the vapor, drawn from the oven is blown back into the oven through the oven wall region having multiple apertures whose maximum dimensions are less than one-half of a free space wavelength of the microwave energy and hence prevent the escape of microwave energy into the blower system or burner.

BRIEF DESCRIPTION OF THE DRAWINGS

Other and further embodiments of the invention will become apparent as the description thereof progresses, reference being had to the accompanying drawings wherein.

DESCRIPTION OF THE PREFERRED EMBODIMENT

Figure 3:
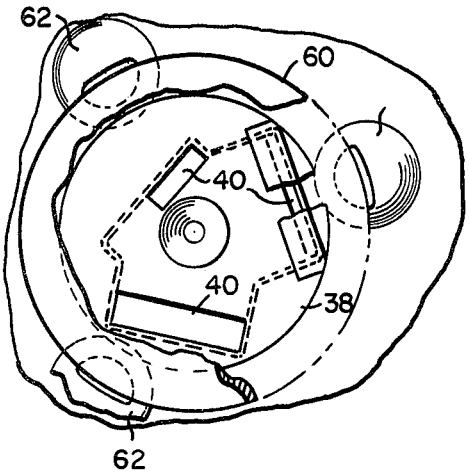
FIG. 3 illustrates an enlarged sectional view of the microwave radiator structure of FIG. 1 taken along line 3—3 of FIG. 1.
Figure 1:
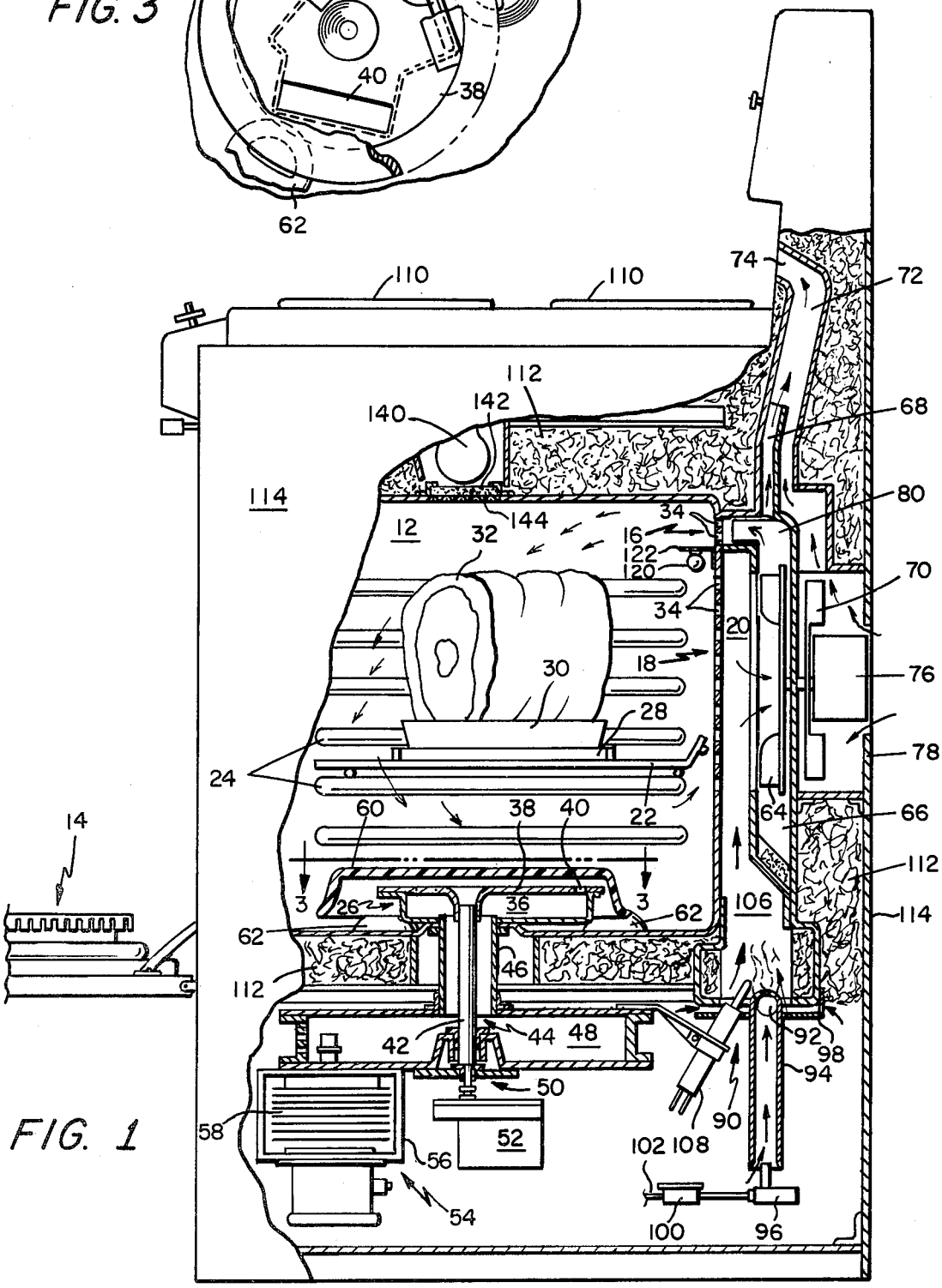
FIG. 1 illustrates a partially broken away side elevation view of an oven embodying the invention.
Figure 2:
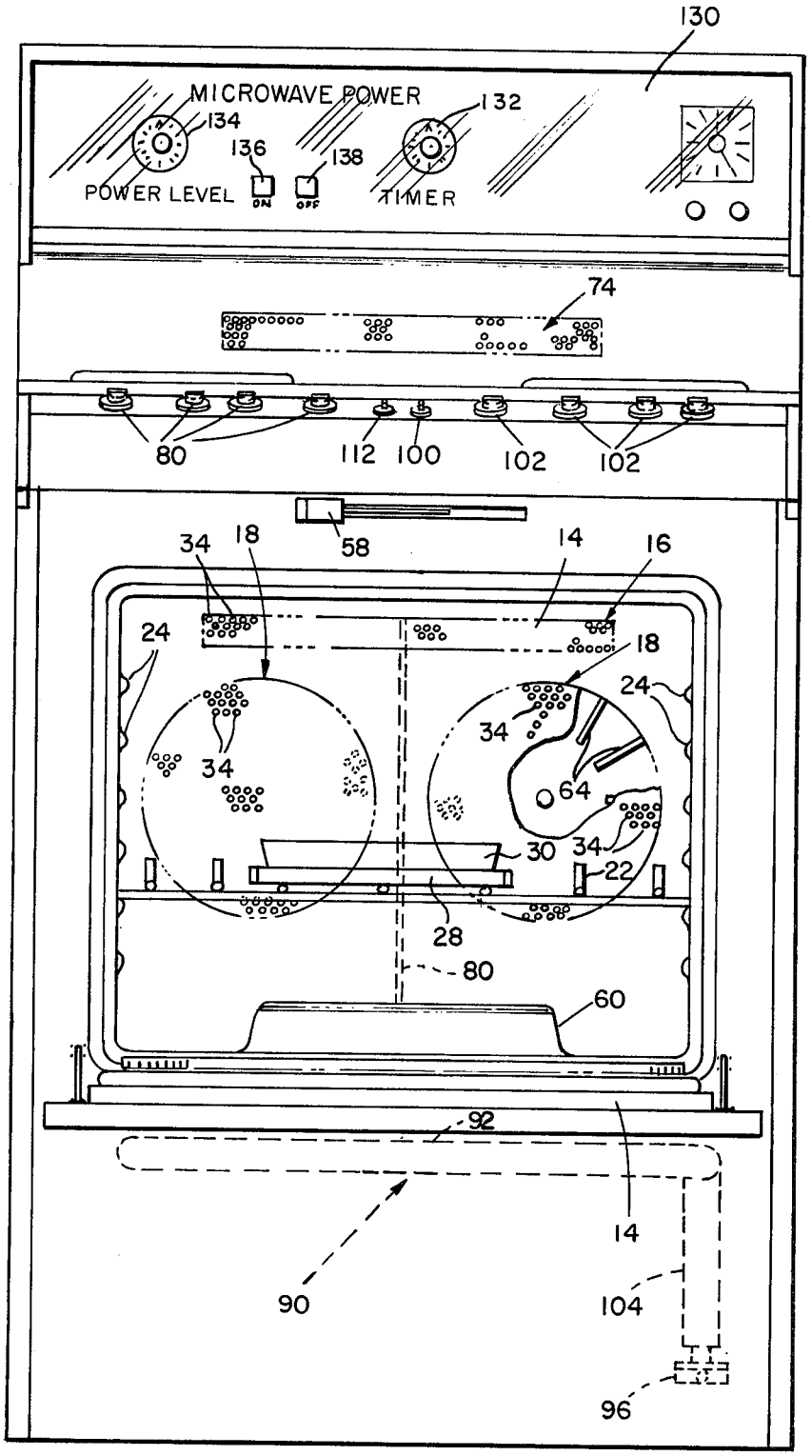
FIG. 2 illustrates a front view of the oven illustrated in FIG. 1.

Referring now to FIG. 1 there is shown a combination gas convection and microwave stove 10 embodying the invention. Stove 10 comprises an oven cavity 12 which is closed by a door 14 during operation. Cavity 12 has elongated vapor inlet region 16 through which heated vapor is directed into the oven 12, and a vapor outlet region 18 through which vapor is drawn out of the enclosure 12 into a blower input plenum 20. A rack 22 made, for example, of steel rods is supported on bumps 24 formed in the side walls of the enclosure 12 so that the position of the rack 22 may be changed in accordance with well-known oven practice. Positioned below rack 22 is a rotatable microwave energy radiator 26 which directs microwave energy up through the apertures in rack 22 and through a support plate 28, positioned in the middle of rack 22, and through a dish 30 containing a food body 32 such as a roast of meat. Dish 30, as well as plate 28, are preferably substantially transparent to microwave energy so that the lower region of food body 32 and the interior portions thereof may be heated effectively by microwave energy.

Regions 16 and 18 preferably have a plurality of apertures 34 whose maximum dimensions are substantially less than a half wavelength of the free space wavelength of the microwave energy radiated into cavity 12. Preferably apertures 34 having maximum dimensions of, for example, less than a tenth of the free space wavelength of the microwave energy radiated into oven 12 by radiator 26 so that microwave energy radiated into enclosure 12 will not escape through regions 16 or 18.

Radiator 26 may comprise, for example, a plenum 36 whose upper surface 38 contains a plurality of apertures 40 through which microwave energy is radiated upwardly into oven 12. A central conductor 42 of a coaxial line 44 supports plenum 36 by being attached to the center of upper plate 38. Conductor 42 extends downwardly through the outer conductor 44 of coaxial line 44 and through a waveguide 48 to a microwave choke and bearing assembly 50. An extension of conductor 42 is rotated by a motor 52 below waveguide 48.

Microwave energy from a magnetron 54 is fed through waveguide 48 and coaxial line 44 to radiator 26. A blower 56 blows air passed the fins 58 of magnetron 54 to cool the magnetron, but none of this air passes through waveguide 48. A cover 60 of microwave transparent material is supported over radiator 26 on centering bumps 62 on the bottom of oven 12 to cover radiator 26 and thereby prevent food juices or other material from being dropped on radiator 26. Further details and advantages of such a microwave oven feed and directive energy rotating structure, as well as a door seal therefrom, are disclosed in greater detail in the aforesaid copending application. However, any desired microwave feed structure, radiator, and/or door seal could be used.

When closed, door 14 is preferably sealed to enclosure 12 by a high temperature vapor seal with a microwave choke structure positioned between said vapor seal and the interior of enclosure 12 so that microwave energy radiated into oven 12 is largely prevented from being absorbed from the high temperature vapor seal. However, any microwave energy passing through said choke section is substantially absorbed by the high temperature vapor seal. When door 14 is closed, a latch is mechanically moved to lock door 14 shut and to permit energization of the magnetron 48. In accordance with this invention a slight negative pressure is produced within plenum 20 by a blower system comprising two centrifugal blowers 64 which draw vapor out of cavity 12 through apertures 34 into plenum 20 and blows it out into plenums 66 surrounding blowers 64 and supplying region 16. The upper ends of plenum 66 are connected to an opening through which a small portion of the output of blowers 64 pass through an outlet vent 68 where the air is mixed with the air blown by a second set of blowers 70. Blowers 70 draw cool air in from the back of the stove 10 to cool the air in duct 72 which exits through a screened aperture 74 in the top of the stove above the cooking surface thereof.

As shown in FIG.'s 1 and 2, each of the apertured regions 18 supplies vapors from the oven sucked to a different blower 64, and each blower 64 is driven along with one of the blowers 70, by a separate motor 76 which is supported from a back wall 78 of the oven. A partition 80 between the two blowers 64 prevents tangential interaction of the vapor output of the blowers 64. Blowers 64 preferably rotate in opposite directions to cause the air between the blowers to move upwardly adjacent partition 80. It should be clearly understood that a single blower could be used in place of the dual blowers 64 and the plenum 66 could have ducting systems to direct the vapor through openings 16 into the oven. However, it has been found that the dual counter rotating blower system can improve the uniformity of convection heating in the oven.

A burner system 90 positioned at the bottom of stove 10 in a compartment behind and below enclosure 12 comprises a horizontal apertured tube 92 extending substantially the entire width of the oven and fed through vertical tubular member 94 with a gas-primary mixture supplied with gas through a gas valve 96. Secondary air is regulated by the spacing of a plate 98 from the bottom of the entrance of the burner plenum. A pressure regulator 100 connected to a gas line input 102 supplies gas valve 96. When the oven is turned on, an ignitor 108 is electrically energized and heats to a temperature which will ignite an air-gas mixture whereupon valve 98 opens, thereby causing said mixture to emanate from the apertures in tube 92 and producing a flame in burner plenum 106. Flue gas products in plenum 106 are drawn into plenum 20 along with excess secondary air by blowers 64 where the combustion products and secondary air are mixed with vapor drawn through apertures 34 from enclosure 12.

Burner 90, preferably run with excess secondary air to reduce the temperature of the products of combustion, is below 3,000° F. so that substantially no oxide products of nitrogen are produced and combustion is substantially complete. Preferably sufficient excess secondary air is drawn into plenum 106 by the negative pressure in plenum 20 to produce a temperature in burner plenum 106 of 1,200° F. to 2,000° F. Plenums 20 and 106 extend substantially the full width of the back of enclosure 12 so that the burner plenum temperature is substantially uniform across said width. Thus, since the blower speed is constant, the slight negative pressure in combustion plenum 106 is substantially constant and accurately regulates the burner primary and secondary air drawn into the combustion chamber. The gas fed into the chamber is also constant due to pressure regulator 100 so that the excess air is accurately controlled.

A plurality of top gas burners 110 is provided which operate as convention gas surface burners in accordance with well-known practice. Thermal insulation 112 is provided around the enclosure 12 and around the burner plenum 106 to reduce loss of thermal energy from the entire stove 10. A skin 114 of, for example, sheet metal surrounds the enclosure 12, the blower region, and the burner and microwave supply region.

During operation, the temperature of the enclosure vapor is sensed by a temperature sensor bulb 120 mounted, for example, in the oven on a bracket 122 below the vapor inlet 16 from the plenum 66. The positioning of sensor 120 is preferably chosen so that it is not directly in the entering hot vapor stream from inlet 16 but rather senses the temperature of the vapor circulating in the enclosure 12. The location of sensor 120 may be selected so that the oven heating cycles have reasonable time periods for burner on and burner off and the temperature range fluctuate large amounts. When the oven is energized, the recirculating blowers 64 run continuously and when the burner 90 is energized, heat is delivered in the form of hot vapor substantially directly to the food body 32 in enclosure 12 and a substantially uniform heating pattern occurs.

Microwave energy power level and timer are controlled, for example, by a control panel 130 containing a timer 132 a power level 134, and on/off buttons 136 and 138. In addition, a light 140 positioned outside oven 12 but illuminating oven 12 through a light transparent high temperature ceramic 142 and a microwave shielding screen 144 may be provided. The microwave system may be energized, for example, from a 110 volt 60 cycle AC supply.

In accordance with this invention there is disclosed the discovery that browning of a food body such as roast 32 can be controlled by blowing hot vapor through inlet region 16 while radiating full power of microwave energy into the oven. This effect appears to occur due to surface effects of the velocity of hot air drying moisture from the surface of the food body and can occur with microwave energy being more readily absorbed by the dry food body surface to brown the food body surface, and therefore, an added broiler unit is not necessary.

An example of power levels for effective food body browning may be microwave energy applied at a rate of 500–800 watts or around 2,000–3,000 BTU's per hour and a gas burner heating rate of about 5,000–15,000 BTU's per hour. Such power levels will bake and/or brown a cake in a few minutes.

This completes the description of the preferred embodiments of the invention. Although preferred embodiments have been described, it is believed that numerous modifications and alterations thereto would be apparent to one having ordinary skill in the art without departing from the spirit and scope of the invention. For example, the oven may be fed through apertures located in regions other than the back wall, other systems for supplying microwave energy to the oven may be used and other types of circulating systems and burners may be used. Accordingly, it is intended that this invention be not limited to the particular details of the embodiment illustrated herein except as defined by the appended claims.

What is claimed is:

1. In combination:

a conductive enclosure supplied with microwave energy;

a combustion plenum positioned outside said enclosure;

a burner for supplying fuel to said combustion plenum;

a blower system positioned above said combustion plenum, said blower system drawing vapor from said enclosure through a first set of perforations and recirculating said vapor past a vent back into said enclosure through a second set of perforations, a portion of said vapor being exhausted through said vent; and said combustion plenum communicating with the input of said blower system outside said enclosure wherein products of combustion from said combustion plenum are drawn through said blower system before being directed into said enclosure wherein a substantially constant negative pressure is created in said combustion plenum for drawing primary combustion air and fuel from said burner.

2. In combination:

a conductive enclosure supplied with microwave energy through a rotating radiating in said enclosure;

said microwave energy being generated outside said enclosure and passing through a wall of said enclosure through a feed which prevents vapor from passing through said feed;

a gas burner in communication with a combustion plenum positioned outside said enclosure;

blower means positioned above said combustion plenum and in direct communication therewith without passing through said enclosure for drawing primary combustion air and fuel through said burner and secondary air past and burner into said combustion plenum; and said blower means drawing vapor from said enclosure to mix with combustion products of said combustion plenum and blowing a major portion of said vapor and said products of combustion of said burner into said enclosure while exhausting a sufficient portion of said vapor out a vent to control the amount of said combustion products drawn from said combustion plenum.

3. A microwave oven comprising:

a conductive enclosure;

means for directing microwave energy into said enclosure through means comprising a rotating radiator which prevents the escape of vapor from said enclosure;

a burner positioned outside said enclosure;

means positioned outside said enclosure for blowing a vapor drawn from said enclosure and heated by mixing outside said enclosure with products of combustion of said burner into said conductive enclosure past a vent through means which prevents the escape of microwave energy from said enclosure, a portion of said vapor and products of combustion being exhausted through said vent; and said blowing means controlling the flow of primary and secondary air through a combustion plenum of said burner by creating a negative pressure therein.

4. A microwave oven in accordance with claim 3 wherein:

said burner is a gas burner positioned below said enclosure.

5. In combination:

a conductive enclosure supplied with microwave energy, said enclosure having a wall with perforations;

a blower system positioned outside said enclosure, said blower system having an input communicating with said enclosure through said perforations in said wall, said blower system having an output coupled past a vent to said enclosure wherein the blower system recirculates vapors between said blower system and said enclosure, a portion of said recirculating vapor being exhausted through said vent;

a combustion plenum communicating with said input to said blower system outside said enclosure wherein vapors are drawn from said plenum creating a substantially constant negative pressure therein, said vapors from said plenum mixing at said input with said vapors recirculating from said enclosure through said perforations; and a burner for providing fuel to said combustion chamber.

6. The combination in accordance with claim 5 wherein said plenum communicates with said input to said blower system by a duct having a horizontal cross-sectional area less than a horizontal cross-sectional area of said plenum.

* * * * *